US005349764A

United States Patent [19]

Posner

[11] Patent Number: 5,349,764

[45] Date of Patent: Sep. 27, 1994

[54] SHOE SECUREMENT APPARATUS

[75] Inventor: Scott Posner, Michigan City, Ind.

[73] Assignee: Dan Lynn Industries, Inc., Michigan City, Ind.

[21] Appl. No.: 897,899

[22] Filed: Jun. 12, 1992

[51] Int. Cl.[5] ..... A43B 11/00

[52] U.S. Cl. ..... 36/50.1; 36/54; 36/1; 24/714.6

[58] Field of Search ..... 36/50.1, 50.5, 54, 1; 24/306, 712.1, 712.4, 713, 713.2, 714.6

[56] References Cited

U.S. PATENT DOCUMENTS

| | | | |
|---|---|---|---|
| 431,737 | 7/1890 | Bertrand | 36/50.1 |
| 705,817 | 7/1902 | Brown | 24/714.6 |
| 796,258 | 8/1905 | Scott | 36/50.1 |
| 923,860 | 6/1909 | Kroell | 24/712.1 |
| 1,022,808 | 4/1912 | Woods | 36/50.1 |
| 1,507,189 | 9/1924 | Keyes | 24/713.2 |
| 2,113,731 | 4/1938 | Kennedy | 24/713.2 |
| 2,418,168 | 4/1947 | Fossa . | |
| 4,458,373 | 7/1984 | Maslow . | |
| 5,016,327 | 5/1991 | Klausner | 24/714.6 |
| 5,117,567 | 6/1992 | Berger | 36/54 |
| 5,158,428 | 10/1992 | Gessner et al. | 24/712.1 |

*Primary Examiner*—Paul T. Sewell
*Assistant Examiner*—M. D. Patterson
*Attorney, Agent, or Firm*—Lee, Mann, Smith, McWilliams, Sweeney & Ohlson

[57] ABSTRACT

Laces are secured through a shoe by a plurality of guides and indentations along the ankle portion of the shoe to tighten and take up slack of a shoelace which includes mating material attached to the ends and which is secured to a shoe by mating surfaces formed of interlocking bristle-like material, such as a hook and loop arrangement.

19 Claims, 3 Drawing Sheets

FIG. 1
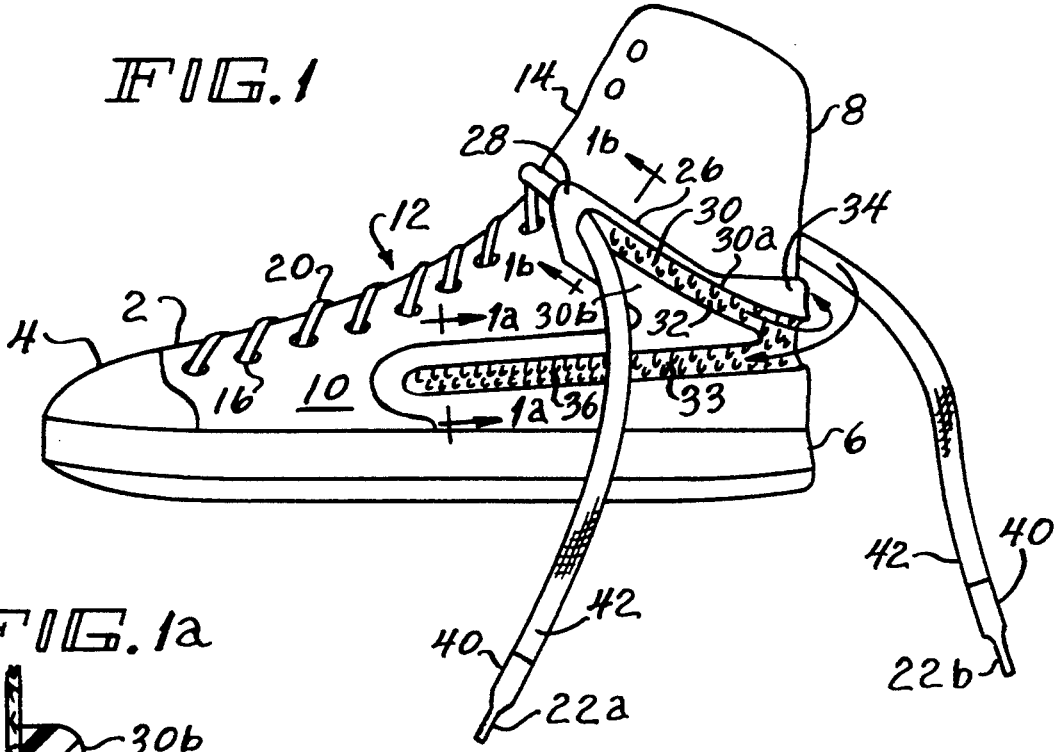
FIG. 1a
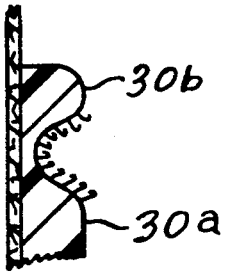
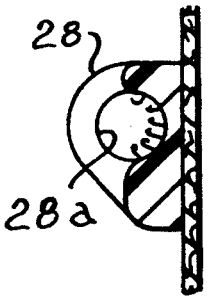
FIG. 1b
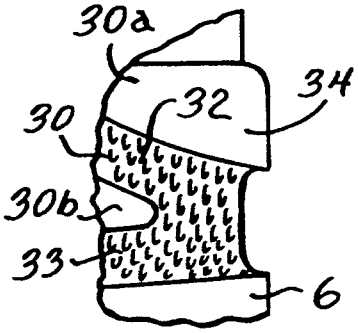
FIG. 1c

FIG. 2
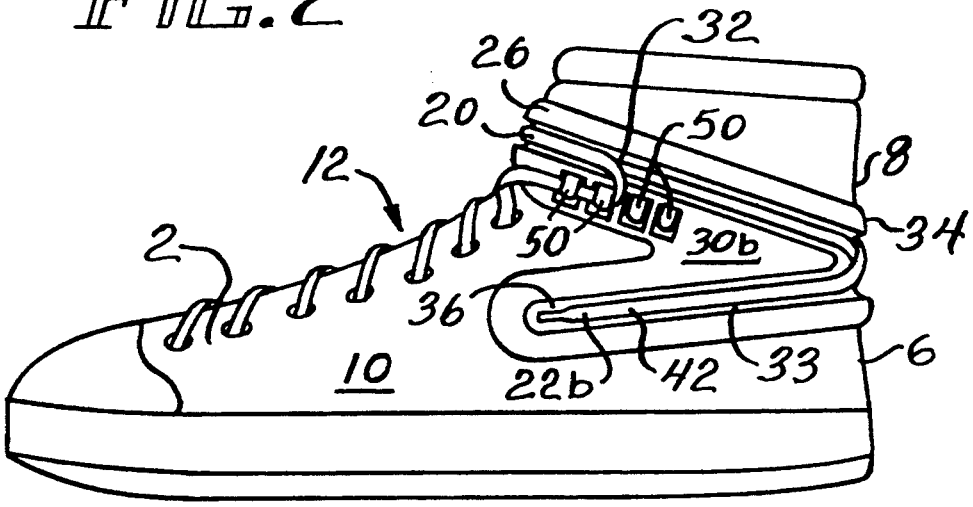
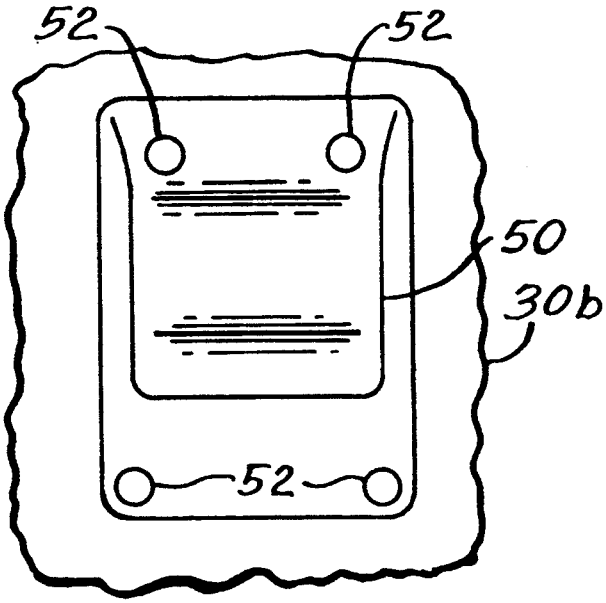
FIG. 3
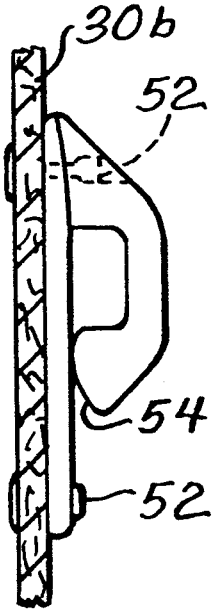
FIG. 3a

FIG. 4
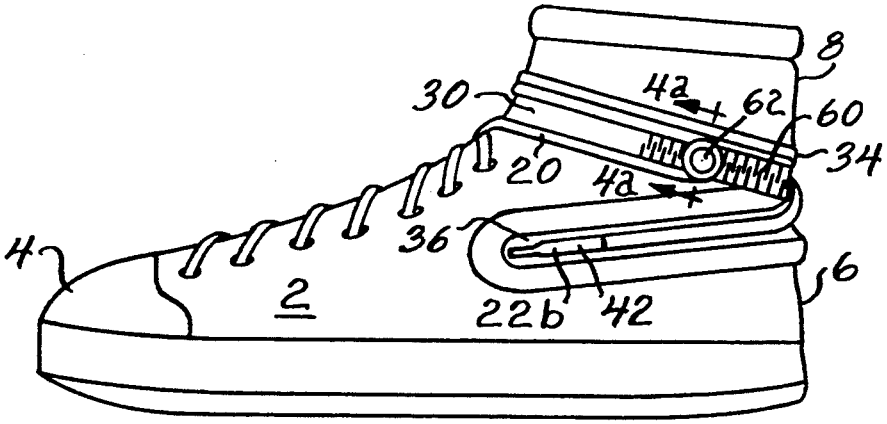
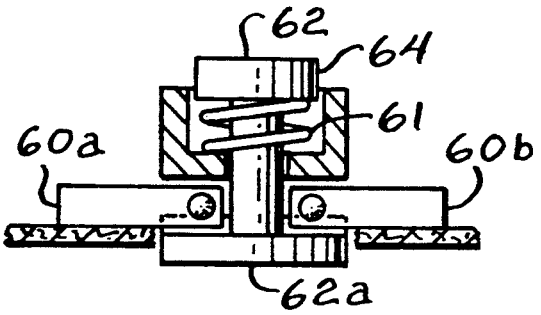
FIG. 4a
FIG. 5
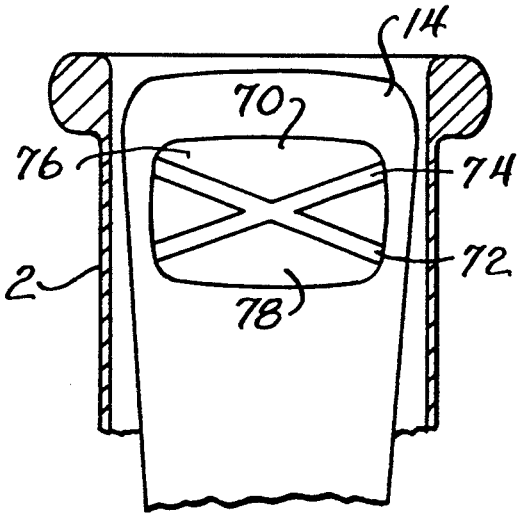

SHOE SECUREMENT APPARATUS

BACKGROUND OF INVENTION

For many years lace tied shoes have been in use wherein the shoe is secured to the foot with laces running criss-cross along the top portion of the shoe. The laces must be tied in order to secure the shoe to the foot and untied to remove the shoe.

The most common method for tying shoelaces is the bowtie knot. The bowtie knot, however, will frequently become undone while the individual is engaged in everyday activities. Most people tie an additional overhand knot to the bowtie knot which is commonly known as a "double knot" in order to achieve a secure knot. Unfortunately, this particular knot is very difficult to untie and occasionally the laces must be cut, or a sharp object must be inserted between the laces to pry the laces free from each other.

There are other types of knots that are more suitable for tying two pieces of string together but are seldom used because of the time involved to learn and practice them.

Children frequently have trouble tying shoelaces correctly. Often the laces that they tie become undone by themselves while playing and must be retied, but usually not until they have been tripped over and injury has occurred. The elderly also have trouble tying a secure knot in shoelaces. To bend down and tie a secure knot in a shoelace with lower back problems and/or arthritis can be difficult, if not impossible. Often the knot they do manage to tie in a shoelace becomes undone, offering the opportunity to trip over the shoelaces and incur injuries.

Athletes, such as long distance runners, hockey players, and cyclists have their sports footwear on for extended periods of time. Their feet swell up and become uncomfortable due to excess blood pressure and perspiration in and around their feet. These athletes need to quickly readjust the laces on their shoes in order to relieve the pressure on their feet, an inconvenience for athletes during competition because of the time involved to untie and tie secure knots.

Another problem associated with secure knots is that after an activity the individual wearer is tired and would like to easily remove his shoes. Often, shoelaces become tangled and are not easily undone. Additionally, ordinary shoelaces hang over the sides of the shoes and can easily get caught or wrapped around something, i.e. a bicycle pedal, after they have been tied.

As an alternative to shoe laces the prior art has attempted to use a plurality of straps with hook and loop fasteners instead of laces. The use of hook and loop fastener secured straps makes shoes easier to remove but does not provide the strength under load to keep a shoe secure where, for example, a bicyclist sprints or an athlete "cuts" planting a foot to change direction. Under these circumstances the typical hook and loop fastener secured straps release prematurely. Therefore, the use of laces has certain advantageous.

The shoe securement apparatus of the present invention overcomes these disadvantages of ordinary shoelaces and other quick fastening apparatus on sports footwear, sneakers, and shoes of all types, in that the shoe is securely fastened without the use of knots and will not come undone while in use, but yet is easily removable.

SUMMARY OF INVENTION

The present invention provides a shoe securement apparatus for securing a shoe to a foot without the use of knots, or the like. The present invention provides for a plurality of posts or clips and indentations on a shoe to take up slack of laces and secure them thereto. The shoelaces are tightly secured against the sides of the shoes, which eliminates the problem of ordinary shoelaces that hang out from the sides of shoes.

In accordance with the invention, shoelaces are secured through guides and indentations along sides of shoe to tighten and take up slack of the shoelaces. The laces are then secured to the sides of the shoe with a fastening means formed of interlocking bristle-like materials, such as a hook and loop fastener arrangement, to attach the ends of the laces to the sides of a shoe quickly and securely. This eliminates the need to tie and untie secure "double knots" in shoelaces.

Non-mating materials are provided at the ends of the laces which prevent the ends of the laces from adhering to fastening means on the sides of said shoe so that the ends of the laces can be grasped quickly to free the laces from the sides of the shoe and release pressure, to adjust, or remove said shoe in a timely fashion.

DESCRIPTION OF THE DRAWINGS

FIG. 1 is a side view of a shoe utilizing one embodiment of the present invention.

FIG. 1A is a sectional view of the end of a channel of the present invention.

FIG. 1B is a sectional view of a guide in the present invention.

FIG. 1C is a fragmentary view of a portion of the guide of the present invention.

FIG. 2 is a side view of a shoe utilizing an alternative embodiment of the present invention.

FIG. 3 is a side view of a clip of the present invention secured to a shoe.

FIG. 3A is a sectional view looking rearwardly of the clip of FIG. 3 on the shoe of FIG. 2.

FIG. 4 is a side view of a shoe utilizing an alternative embodiment of the present invention.

FIG. 4A is a sectional view of an adjustable post of the alternative embodiment of FIG. 4.

FIG. 5 is a front end view of a tongue of a shoe utilizing an alternative embodiment of the present invention.

DETAILED DESCRIPTION OF THE PREFERRED EMBODIMENTS

As shown in FIG. 1, a shoe 2 includes a toe 4, a heel 6, an ankle support portion 8, first and second sides 10 and 12, a tongue 14 extending along the front of the shoe 2 from the toe 4 to the ankle support portion 8, and a plurality of apertures 16 extending through the first and second sides 10 and 12 of the shoe 2 along the tongue 14. Additionally, a lace 20 having first and second ends **22*a* and 22*b* extends through said apertures 16 to secure said shoe 2 to a foot. The shoe securement apparatus includes a preformed channel 26 located on both sides 10 and 12 of said shoe 2 at the ankle support portion 8. An indentation 30 defined by walls 30*a* and 30*b* extends in said preformed channel 26 along the sides 10 and 12 of the shoe 2 to form a diagonal groove 32 and around the back of the shoe 2 between the heel 6 and the ankle support portion 8, and further extends along the sides 10 and 12 of the shoe 2 to form a horizontal groove 33. A lip 34 is formed by the indentation 30** at the back of the shoe 2 between the heel 6 and the ankle support portion 8. This lip 34 is adapted to engage the lace 20 during tightening to prevent vertical movement thereof along the back of the shoe 2. The horizontal groove 33 of the indentation 30 includes a fastening portion 36 disposed therein, such as a first portion of a hook and loop fastener.

The lace 20 includes a non-mating or non-fastening portion 40 at the first and second ends 22*a* and 22*b*. Directly adjacent the non-mating or non-fastening material 40 is a mating or fastening portion 42, such as a second portion of a hook and loop fastener.

In use, the first and second ends 22*a* and 22*b* of the lace 20 are threaded through a guide 28 having an aperture 28*a* and into the hollow preformed channel 24. The lace is run along the diagonal groove 32 of the indentation 30 around the back of the shoe 2 where the lip 34 is engaged and then around to the opposite side 10 or 12 respectively, and into horizontal groove 33. Each end 22*a* and 22*b* is then affixed to said fastening portion 36 at said mating portions 42 of said lace 20. In this fashion, the shoe 2 can be secured to a foot quickly without the necessity of tying knots.

To remove shoe 2 or adjust the laces 20, non-mating portions 40 of the lace 20 are grasped and pulled away from fastening portion 36. These non-mating portions 40 will not be affixed to the fastening portion 36 disposed in said horizontal groove 33 of said indentation 30 because of non-mating materials that have either been attached by integral weaving, sewing or gluing to ends 22*a* and 22*b* of said lace 20. The shoe 2 can now be quickly adjusted or removed.

The indentations 30 along shoe 2 are designed to keep lace 20 aligned so its length lies in the direction of pulling forces and in line with the fastening portion 36. The indentations 30 also aid in fastening said laces 20 to the sides 10 and 12 of said shoe 2. Therefore, the laces 20 cannot slip along the sides 10 and 12 of said shoe as said laces 20 are being tightened. Also, the walls 30*a* and 30*b* along the shoe 2 make it nearly impossible for the laces 20 to get snagged on anything when the laces 20 are pulled along and secured within the horizontal groove 33 of the indentation 30.

The arrangement of indentations 30 with lace 20 passing through grooves 32, wrapping around heel 6 and lip 34 to opposite sides 10 and 12 respectively and then into grooves 33 provides substantial increase in surface area and changes in direction of vectors of forces, providing increased friction and accompanying added security through the geometry of the indentations 30.

Walls 30*a* and 30*b* can be viewed as an exterior perimetral wall and interior wall respectively, wall 30*a* passing into lip 34 and around to a corresponding wall on the opposite side. Wall 30*b* extends continuously from guide 28 defining the bottom of groove 32 and the top of groove 33.

Besides functioning as a securing area, the indentations 30 can also act to hide laces 20, and achieve aesthetically different looks. In fact, the design of indentations 30 and fastening means 36 can be changed in numerous ways without departing from the scope of this invention, FIG. 2 shows another embodiment of the invention. This embodiment includes a plurality of clips 50 spaced along the first and second sides 10 and 12 of the shoe 2 in a row between the diagonal groove 32 and the horizontal groove 33 of the indentation 30 along interior wall 30*b*. As best seen in FIG. 3, each clip 50 is secured to the side of a shoe 10 or 12. The clips 50 can be secured by a plurality of rivets 52, formed or embedded into wall 30*b* of channel 26 or can be sewn to the side 10 or 12 of the shoe 2. The clips 50 include an angled edge 54 which provides an easy means for laces to be pulled up into the clips 50. Clips 50 therefore serve as guides for lace 20.

In operation, the ends 22*a* and 22*b* of the lace 20 are directed first through the clips 50 to take up any slack in the lace 20. The ends 22*a* and 22*b* are then lead through channel 26 into the diagonal groove 32 of indentation 30, around the ankle support portion 8 of the shoe 2 and into the horizontal groove 33 of the indentation 30. As the ends 22*a* and 22*b* are drawn around the ankle support portion 8, the lip 34 located on the back portion of the shoe 2 between the ankle support portion 8 and the heel 6 is engaged. The ends 22*a* and 22*b* of the lace 20 are then secured to the fastening portion 36 located in the horizontal grooves 33 of the indentation 30 by the mating portions 42 at the ends 22*a* and 22*b* of the lace 20.

In another embodiment of the shoe securement apparatus as shown in FIG. 4, a set of geared tracks 60 having opposed gear segments 60*a* and 60*b* are located on the ankle support portion 8 of the shoe 2. A clip 62 is slidably engaged in each of the geared track 60. A button 64 located on each clip 62, when pressed against a biasing spring 61, allows for slidable adjustability of each clip 62 with respect to the flexible geared track 60. When the button 64 is released, the clip 62 is locked into place by engagement of pawl 62*a* with segments 60*a* and 60*b* with respect to the geared track 60. In use, the first and second ends 22*a* and 22*b* of the lace 20 are threaded through the clip 62. The button 64 is depressed to adjust the toeward or heelward position of the clip 62 with respect to the flexible geared track 60 to take up any slack found in the lace 20. The ends 22*a* and 22*b* of the lace 20 are then drawn around the front of the ankle support portion 8 into the indentation 30 and through groove 32, then around the back portion of the ankle support portion 8 to engage the lip 34. Each end 22*a* and 22*b* of the lace 20 is then drawn into the horizontal groove 33 of the indentation 30 and secured thereto by the fastening portion 36 and mating portion 42, respectively. Clip 62 is an alternative form of guide for lace 20.

Additionally, as seen in FIG. 5, a large adjustable channeled clip 70 can be secured to the tongue 14 of the shoe 2 to further tighten and secure the laces 20. The adjustable clip 70 includes a pair of hollow channels 72 and 74 running in a criss-cross fashion, whose function will be apparent hereinafter. Additionally, the clip 70 includes a top section 76 and a bottom section 78 slidably adjustable with respect to one another. The top section 76 can be easily engaged against the bottom section 78 to tighten and secure the first and second ends 22*a* and 22*b* of the lace 20 therein.

In use, as adapted to the clip embodiment of FIG. 2, the first and second ends 22*a* and 22*b* of the lace 20 are drawn up into the clips 50, then ends 22*a* and 22*b* are drawn up into the channels 72 and 74 in a criss-cross fashion and pulled securely therethrough. The top portion 76 of the adjustable clip 70 is then engaged against the bottom portion 78 of the adjustable clip 70 to secure the first and second ends 22*a* and 22*b* of the lace 20 therein. The first and second ends 22*a* and 22*b* are then threaded through channels 26 and secured as previously discussed.

Various features of the invention have been shown and described in connection with the illustrated embodiments of the invention. However, it must be understood that these particular arrangements merely illustrate, and that the invention is to be given the fullest interpretation within the terms of the appended claims.

What is claimed:

1. A shoe securement apparatus for a shoe employing a lace to interconnect two sides of the shoe comprising:

a guide positioned on one side of the shoe for directing the lace;

a channel positioned on one side of the shoe for receiving the lace;

a first groove formed in said channel for receiving the lace as directed from said guide;

a second groove formed in said channel having a first end in communication with said first groove and a second end remote from said first end; and a fastener being fitted in said second end adapted to holding the lace in position as the lace is directed through said second groove.

2. The invention according to claim 1 wherein said channel being formed of opposed first and second walls defining said grooves, said first groove being a diagonal and extending downwardly into said second groove, said second groove extending horizontally from said first groove, said first wall being enlarged to form a lip, and the lace being looped around said lip as it is directed from said first groove to said second groove.

3. A shoe securement apparatus for a shoe employing a lace to interconnect two sides of the shoe comprising:

a guide positioned on one side of the shoe for directing the lace;

a channel positioned on one side of the shoe for receiving the lace, said channel having a first and second wall forming a substantially symmetrical first and second groove positioned on each side of the shoe, said first groove receiving the lace as directed from said guide, said second groove having a first end in communication with said first groove and a second end remote from said first end, said first groove being a diagonal groove extending downwardly into said second groove, said second groove extending forwardly and horizontally, said first wall being enlarged to form a lip to direct the lace from said first groove to said second groove, said grooves in communication with one another below the lip for directing the lace to cross to the opposite side of the shoe for securement; and a fastener positioned in said second end and adapted for holding the lace in position as the lace is directed through said second groove.

4. A shoe securement apparatus for a shoe employing a lace to interconnect two sides of the shoe comprising:

a guide positioned on one side of the shoe for directing the lace;

a channel positioned on one side of the shoe for receiving the lace, said channel having a first and second wall forming a substantially symmetrical first and second groove positioned on each side of the shoe, said first groove receiving the lace as directed from said guide, said second groove having a first end in communication with said first groove and a second end remote from said first end, said first groove being a diagonal groove extending downwardly into said second groove extending forwardly and horizontally, said first wall being enlarged to form a lip to direct the lace from said first groove to said second groove, said grooves intersecting with one another below the lip for directing the lace to cross to the opposite side of the shoe for securement, said guide being an aperture in communication with said first groove and formed by a ring extending between said walls; and a fastener positioned in said second end and adapted for holding the lace in position as the lace is directed through said second groove.

5. The invention according to claim 3 and said guide being a clip formed to extend outwardly from said first wall and having an aperture with a lace entrance for receiving said lace and directing it to the groove on the opposite side of the shoe.

6. The invention according to claim 5 and said guide further comprising a plurality of selectable clips enabling the taking up of unwanted slack and length in said lace.

7. The invention according to claim 3 and said guide being an adjustably positionable post engaging a track and formed to extend outwardly from said first wall for receiving said lace and directing it to the groove on the opposite side of the shoe.

8. A shoe securement apparatus for a shoe employing a lace to interconnect two sides of the shoe comprising:

a channel positioned on one side of the shoe for receiving the lace, said channel having opposed first and second walls and defining a substantially symmetrical first and second groove on each side of the shoe, said first groove formed in said channel for receiving the lace from said guide, said second groove in said channel having a first end in communication with said first groove and a second end remote from the first end, said channel being formed of opposed first and second walls defining said grooves, said first groove being a diagonal groove extending downwardly into said second groove, said second groove extending forwardly and horizontally, said first wall being enlarged and forming a lip for directing the lace from said first groove to said second groove, said grooves in communication with one another below the lip;

a guide positioned on one side of the shoe for directing the lace, said guide comprising a channeled clip formed to extend outwardly from the shoe and adapted to crossingly receive the lace and direct the lace to said first grooves on each side; and a fastener being fitted in said second end adapted to holding the lace in position as the lace is directed through said second groove.

9. A shoe securement apparatus for a shoe employing a lace to interconnect two sides of the shoe comprising:

guide positioned on one side of the shoe for directing the lace;

a channel positioned on one side of the shoe for receiving the lace, said channel having a first and second wall and defining a substantially symmetrical first and second groove on each side of the shoe, said first groove formed in said channel for receiving the lace as directed from said guide, said second groove in said channel having a first end in communication with said first groove and a second end remote from the first end, said first groove being a diagonal groove extending downwardly into said second groove, said second groove extending forwardly and horizontally, said first wall having a lip whereby the lace being looped around said lip as directed from said first groove to said second groove, said grooves intersecting with one another below said lip; and a fastener positioned in said second end and adapted for holding the lace as the lace is directed through said second groove, said fastener being a first portion of a hook and loop fastener arrangement and the lace having a second portion of a hook and loop fastener arrangement near its ends for securement of the lace in said channel, and a non-mating surface near its ends for maintaining detached relationship to the first portion.

10. A shoe apparatus for a shoe having a lace with two ends tying together an opening between a first and second side of the shoe comprising:

means for directing the ends from the opening for securement along the sides;

means for receiving the lace on each of the sides and maintaining the lace in proximity with each of the sides;

means for removably fastening the lace on each of the sides and in position as directed along the sides, said means for directing said ends further comprising two opposed walls defining a first and a second groove on each side of the shoe, said grooves intersecting and directing said lace ends from said first groove on said first side to said second groove on said second side and from said first groove on said second side to said second groove on said first side in a crossing manner to said means for removably fastening the lace.

11. The invention according to claim 10, said means for directing further defining an aperture formed between said walls positioned at the end of said first groove for directing the lace into said groove.

12. The invention according to claim 10 and said means for directing further comprising a plurality of means for clippingly receiving said lace in an aperture formed to retain said lace as it is directed to the opposite side of said shoe for directing into the first groove on said opposite side.

13. The invention according to claim 10 and said means for directing further comprising means for adjustably receiving said lace around a post formed to direct said lace to the opposite side of said shoe for directing into the first groove on said opposite side.

14. A shoe securement apparatus for leading a lace between a first and second side of a shoe comprising:

a first substantially "V" shaped channel defined by at least two intersecting legs on the first side of the shoe;

a second substantially "V" shaped channel defined by at least two intersecting legs on the second side of the shoe;

each leg of each "V" shaped channel being defined by a first and second wall forming a groove, each said groove intersecting and communicating with another said groove, whereby the lace having ends being directed through one said groove to cross into another groove; and at least one fastener positioned in said grooves for removably retaining the lace in contact with said grooves.

15. The invention according to claim 14 wherein each said groove having a guide for directing the lace.

16. The invention according to claim 14 and said first grooves having guides near the tongue opening of the shoe, said guide being a clip enabling engagement of the lace and direction of said lace ends into the first grooves on said opposite side of the shoe and being arrayed as a plurality of clips selectable to take up slack and excess length of the lace.

17. The invention according to claim 14 and said first grooves having guides near the tongue opening of the shoe, said guide being a selectably movable post enabling engagement of the lace and direction of said lace ends into the first grooves on said opposite side of the shoe and movable to take up slack and excess length of the lace.

18. The invention according to claim 14, said guide further comprising a channelled clip on the shoe.

19. The invention according to claim 14 wherein said fastener being a hook and loop fastener with a first portion placed in said groove and a second portion placed on the lace and a non-mating portion placed on the lace enabling enhanced removability.

* * * * *